US011578436B2

(12) United States Patent
Krauss et al.

(10) Patent No.: US 11,578,436 B2
(45) Date of Patent: Feb. 14, 2023

(54) KNITTING MACHINE PARTS AND METHOD FOR PRODUCTION THEREOF

(71) Applicant: GROZ-BECKERT KOMMANDITGESELLSCHAFT, Albstadt (DE)

(72) Inventors: Rainer Krauss, Zell u.A. (DE); Markus Settegast, Geislingen (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 16/968,071

(22) PCT Filed: Jan. 31, 2019

(86) PCT No.: PCT/EP2019/052397
§ 371 (c)(1),
(2) Date: Aug. 6, 2020

(87) PCT Pub. No.: WO2019/154710
PCT Pub. Date: Aug. 15, 2019

(65) Prior Publication Data

US 2021/0054547 A1 Feb. 25, 2021

(30) Foreign Application Priority Data

Feb. 8, 2018 (EP) ..... 18155762

(51) Int. Cl.
*D04B 15/14* (2006.01)
*D04B 15/10* (2006.01)
*D04B 15/18* (2006.01)

(52) U.S. Cl.
CPC ..... *D04B 15/14* (2013.01); *D04B 15/10* (2013.01); *D04B 15/18* (2013.01)

(58) Field of Classification Search
CPC ..... D04B 15/14; D04B 15/18; D04B 15/10
(Continued)

(56) References Cited

U.S. PATENT DOCUMENTS 1,887,340 A * 11/1932 Swinglehurst ..... D04B 15/18 66/115
3,545,233 A * 12/1970 Lombardi ..... D04B 35/30 66/8
(Continued)

FOREIGN PATENT DOCUMENTS

BR 102012025231 A2 3/2016
CN 201753391 U 3/2011
(Continued)

OTHER PUBLICATIONS

Amarillo Gear Service. "What Makes Case Hardening And Surface Hardening Different?". Mar. 16, 2018. Retrieved from internet: "https://www.amarillogearservice.com/what-makes-case-hardening-and-surface-hardening-different/" (Year: 2018).*
(Continued)

*Primary Examiner* — Danny Worrell
*Assistant Examiner* — Aiying Zhao
(74) *Attorney, Agent, or Firm* — Fitch, Even, Tabin & Flannery LLP

(57) ABSTRACT

A knitting machine part comprises a plurality of tool guides, each for one knitting tool. Each tool guide has a hardened region. The majority of the hardened regions are formed to be integral without seams or joints which transition integrally into adjacent, non-hardened regions. At least one hardened region of the knitting machine part is formed by a non-integral region, in that a hardened, separate component is arranged there, which forms the non-integral hardened region. The component can be designed as an insert part and inserted in a receptacle recess. The integral regions are preferably formed by induction hardening of a knitting machine part which is not yet hardened, wherein a separate hardened component can be arranged in each insufficiently
(Continued)

hardened region in order to provide a hardened, non-integral region.

15 Claims, 6 Drawing Sheets

(58) Field of Classification Search
USPC ..... 66/15, 19, 31
See application file for complete search history.

(56) References Cited

U.S. PATENT DOCUMENTS

| | | | | |
|---|---|---|---|---|
| 3,667,113 | A * | 6/1972 | Philip | D04B 15/10 29/527.6 |
| 5,577,401 | A | 11/1996 | Pernick | |
| 5,609,044 | A | 3/1997 | Tacy | |
| 6,176,107 | B1 * | 1/2001 | Pernick | D04B 15/06 66/104 |
| 2012/0006064 | A1 * | 1/2012 | Haug | D04B 35/04 66/115 |

FOREIGN PATENT DOCUMENTS

| | | | | |
|---|---|---|---|---|
| CN | 205133915 | U | 4/2016 | |
| DE | 588717 | C | 11/1933 | |
| DE | 2224031 | A1 | 12/1972 | |
| DE | 109899 | A5 | 11/1974 | |
| EP | 3524722 | A1 | 8/2019 | |
| GB | 735378 | A * | 8/1955 | C21D 9/40 |
| GB | 735378 | A | 8/1955 | |
| GB | 1207684 | A | 10/1970 | |
| GB | 1325212 | A | 8/1973 | |
| GB | 1347272 | A | 2/1974 | |
| TW | M533652 | U | 12/2016 | |

OTHER PUBLICATIONS

European Search Report and Written Opinion dated Mar. 16, 2018, in corresponding European Application No. 18155762.0, with machine English translation (11 pages).

International Search Report and Written Opinion dated Mar. 6, 2019, in corresponding International Application No. PCT/EP2019/052397, with machine English translation (16 pages).

International Preliminary Report on Patentability dated May 7, 2020, in corresponding International Application No. PCT/EP2019/052397, with machine English translation (68 pages).

Written Opinion of the International Preliminary Examining Authority dated Feb. 13, 2020, in corresponding International Application No. PCT/EP2019/052397, with machine English translation (14 pages).

Indian Office Action dated Apr. 27, 2022, in corresponding Indian Application No. 202037031920 (5 pages).

Office Action dated Jun. 6, 2022, in corresponding TW Application No. 108103381 (7 pages).

Notification of Reasons for Rejection for Japanese Patent Application No. 2020-541781 dated Nov. 7, 2022, 12 pages.

* cited by examiner

KNITTING MACHINE PARTS AND METHOD FOR PRODUCTION THEREOF

CROSS REFERENCE TO RELATED APPLICATIONS

This patent application is the national phase of PCT/EP2019/052397, filed Jan. 31, 2019, which claims the benefit of European Patent Application 18155762.0, filed Feb. 8, 2018.

TECHNICAL FIELD

The invention refers to a knitting machine part and a method for production thereof. The knitting machine part has multiple tool guides that are arranged along a straight line next to each other or that are arranged in a circumferential direction about an axis next to each other. The knitting machine part can be a knitting cylinder, a needle bed of a flat bed knitting machine, a rib disc or a sinker ring. Particularly it can either be a cylinder for a Single-Jersey machine as well as a cylinder for a Double-Jersey machine.

BACKGROUND

Such knitting machine parts are subject to wear during operation of a knitting machine. Particularly where knitting tools are moved in tool guides in a movement direction and the knitted fabric applies a force on the knitting tool concurrently that has to be supported by the knitting part or the tool guide, wear can occur.

Due to this stress and in order to reduce wear, at least sections or areas of the tool guides are hardened. First the knitting machine part is manufactured from a non-hardened metallic material and is subsequently hardened at least in a section. Because the at least one hardened section of the knitting machine part cannot be machined or only with high efforts.

One possibility of hardening is the induction hardening (e.g. GB 735 378 A). During induction hardening the workpiece to be hardened is heated by induction and quickly cooled subsequently, whereby the hardness of the material is increased.

The induction hardening of a knitting machine part is not easy due to its size. Depending on the used method, hardening of the knitting machine part in sections can result in that sections hardened before are tempered again due to the hardening of directly adjacent areas. Due to this tempering the hardness is reduced and the goal of hardness increase is not uniformly achieved everywhere.

Thus, it can be considered as object of the present invention to provide a knitting machine part and a method for production thereof that allows a reduced wear at all tool guides.

SUMMARY

This object is solved by a knitting machine part according to features described herein as well as a method for manufacturing with the features described herein.

The knitting machine part has multiple tool guides. Each tool guide is configured to guide a knitting tool in a movement direction along the respective tool guide. Exactly one knitting tool is preferably assigned to each tool guide. The knitting machine part can comprise a first group of tool guides and a second group of tool guides. For example, circular knitting cylinders can have tool guides for knitting machine needles in the circumferential area and tool guides for sinkers at an axial end. A knitting machine part can thus comprise tool guides for a single group and/or type of knitting tools (e.g. in the case of a Double-Jersey cylinder) or for at least two groups and/or types of knitting tools (e.g. in the case of Single-Jersey cylinders).

Each tool guide has a hardened section with a hardness that is larger than the hardness of at least one another non-hardened section of the tool guide. The tool guide is thus not hardened everywhere, but only in the respective hardened section that is subject to particular high stress during operation of the knitting machine. In this particular stressed section the hardness is increased in order to reduce the wear of the knitting machine part.

The majority of the present hardened sections is obtained by at least partly hardening the knitting machine part manufactured from a non-hardened metallic material. These hardened sections are integral sections that are configured integrally without seam or connection location with the at least one non-hardened section of the assigned tool guide respectively. Only a remarkably smaller number of the hardened sections is configured as non-integral section in each case. In a non-integral section at least one or exactly one separate hardened component is arranged for forming the hardened section that is fixedly connected with the knitting machine part. This connection is preferably carried out by an adhesive bond or a substance bond.

Preferably at most 10% or at most 5% or at most 2% or less than 1% of all hardened sections are configured as non-integral sections with a separate component, whereas all of the remaining hardened sections are configured as integral sections. For example, also at most 0.1% or at most 0.2% of the hardened sections can be configured as non-integral sections.

If due to the hardening of the manufactured knitting machine part a sufficient hardness of the section to be hardened cannot be achieved in one or more tool guides, a hardened separate component is attached there. The effort for re-machining and arranging of the separate component is high. The preferred inductive hardening of the tool guides after manufacturing of the knitting machine part from non-hardened material is remarkably more economic. However, depending on the used method and the used device therefore, the desired hardness can possibly not be achieved in each tool guide. At these tool guides separate hardened components are arranged selectively at the knitting machine part. In doing so, in total an effective manufacturing of the knitting machine part is possible and it is guaranteed that each tool guide comprises a hardened section with the required material hardness in order to keep the wear of the knitting machine part low.

Indeed it is known from the prior art to arrange harder materials in recesses at a knitting machine part in order to locally harden the knitting machine part (e.g. GB 1 347 272 A). However, the manufacturing effort for such an approach is enormously high, which increases the costs for the knitting machine part remarkably. On the contrary, according to the invention as most as possible hardened sections are formed as integral sections by hardening of the first non-hardened metallic material. In these integral sections no additional material or component is arranged for increasing the hardness. Only where depending on the method no sufficient hardness can be achieved, a few hardened sections are formed by arranging of a separate hardened component. The components can be stocked in an already hardened condition and can be arranged in or at a tool guide for forming a hardened section, if required.

It is advantageous, if each non-integral section comprises exactly one separate component. In doing so, the effort for forming the hardened sections that are configured as non-integral sections can be minimized.

Preferably each tool guide has a support surface for the knitting tool. Particularly at least a part of the support surface is arranged in the respective hardened section. The part of the support surface arranged in the hardened section forms a hardened surface section. The hardened surface section can be created in the integral section by hardening of the material and thus by microstructural transformation. The hardened surface section can be formed by a component surface of the arranged component in a non-integral section.

It is preferred, if the component surface that forms the hardened surface section has a surface width in transverse direction orthogonal to the movement direction of the knitting tool that is smaller than the tool width of the knitting tool. In doing so, it can be avoided that thread sections guided at the knitting tool get into contact with the transition location between the hardened component and the adjoining less hard material of the knitting machine part. This configuration is particularly of importance, if the component is inserted as insert into a recess and thus an interface or edge is provided between the inserted component and the recess in transverse direction adjacent to the component surface or to the hardened surface section.

The surface width should preferably have an amount of at least 80% of the tool width.

In a preferred embodiment each tool guide has two side webs that limit a guide channel having a channel width for guiding the knitting tool in transverse direction orthogonal to the movement direction of the knitting tool. The channel width thereby is the width of the guiding channel between the two facing side web surface sections that serve to guide the knitting tool. For example, the channel width can be the minimum width of the guiding channel between the side webs.

It is preferred, if a difference between the channel width and the tool width leads to a guide play and the sum of the surface width and the guide play is smaller than the tool width. As an alternative or in addition, the surface width is smaller than the channel width. Due to these measures, the avoidance of the contact between a thread section guided at the knitting tool and the transition location between the component and the adjoining sections of the knitting machine part can be improved.

In a preferred embodiment the guide play can have an amount up to about 0.07 mm, however, is usually smaller than 0.1 mm.

Preferably the at least one component is inserted in each non-integral section in a reception recess. The component can thus be configured as insert part. The component can be completely arranged within the reception recess or can partly project from the reception recess.

In a preferred embodiment the knitting machine part can be continuously ring-shaped in a circumferential direction and can form a ring-shaped disc or a cylinder or hollow cylinder. Thereby the tool guides can be arranged substantially parallel to the axis and/or radially to the axis. For example, a group of tool guides can be orientated axially and another group of tool guides can orientated radially.

For example, one group of tool guides can be configured to guide knitting needles. Another group of tool guides can be configured to guide sinkers. The two groups can be provided at the same or at different knitting machine parts.

The knitting machine part discussed above is manufactured as follows:

First, the knitting machine part with the tool guides is manufactured from a non-hardened metallic material. Subsequently at least a section of the knitting machine part is hardened by using a hardening method in order to create a hardened section at least for the majority of tool guides in each case that transitions as integral section without seam or connection location in the adjoining non-hardened material of the knitting machine part. For example, the hardening can be carried out by induction hardening.

Subsequently one or more insufficiently hardened sections of one or more tool guides are identified. In these insufficiently hardened sections a reception recess is created and one separate component is inserted into each reception location respectively. Components are fixedly connected with the respective reception location, e.g. by means of an adhesive bond.

BRIEF DESCRIPTION OF THE DRAWINGS

Preferred embodiments of the invention yield from the dependent claims, the description and the drawings. In the following preferred embodiments of the invention are explained with reference to the attached drawings. The drawings show:

DETAILED DESCRIPTION

Figure 1:
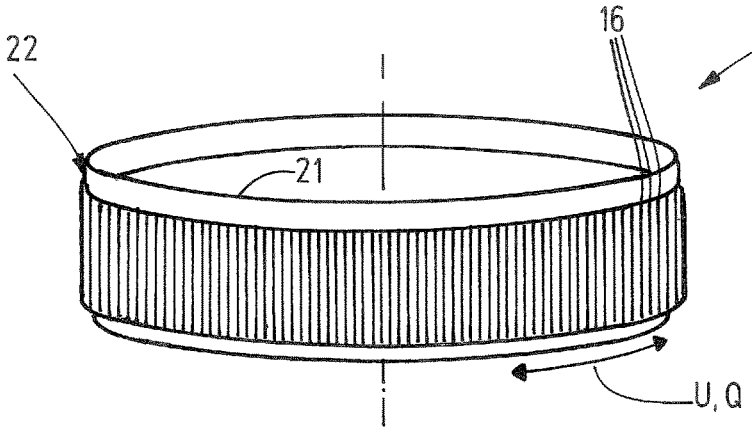
FIG. 1 a schematic perspective illustration of a knitting machine part in the form of a circular knitting cylinder, FIG. 2 a schematic perspective illustration of a knitting machine part in form of a needle bed of a flat bed knitting machine, FIG. 3 a schematic illustration of a tool guide with a hardened section configured as non-integral section, FIG. 4 a schematic illustration of a tool guide with a hardened section configured as integral section, FIGS. 5 and 6 two embodiments of a knitting machine part respectively in perspective partial illustration, wherein two non-integral hardened sections are provided respectively, FIG. 7 another embodiment of two knitting machine parts in which reception recesses for one hardened separate component are introduced respectively, FIG. 8 the embodiment of two knitting machine parts according to FIG. 7, wherein a hardened separate component is inserted in each of the reception locations respectively, FIG. 9 a schematic illustration with view in movement direction on the knitting tools in a tool guide according to a knitting machine part of FIG. 8, FIG. 10 another embodiment of knitting machine parts with a tool guide for a knitting tool respectively that is formed by a sinker in a partially cut illustration and FIG. 11 a flow diagram of an embodiment for manufacturing a knitting machine part.
Figure 2:
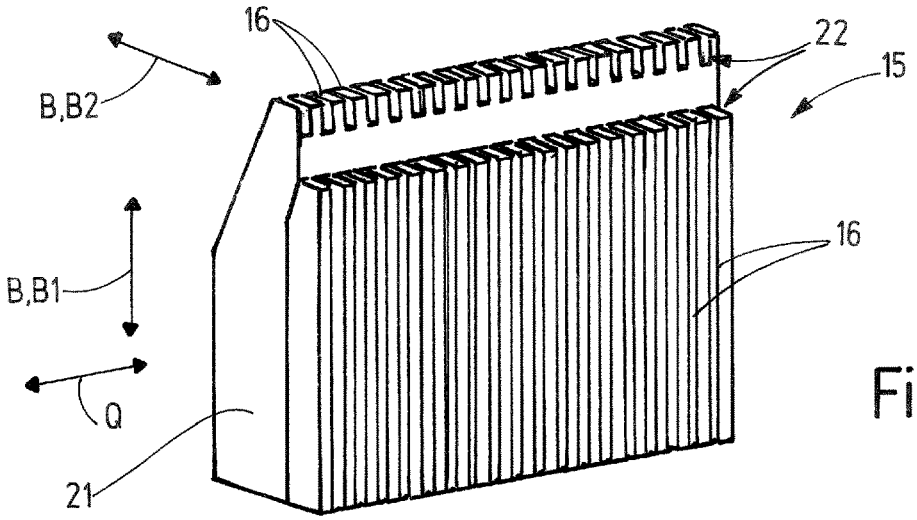
Figure 3:
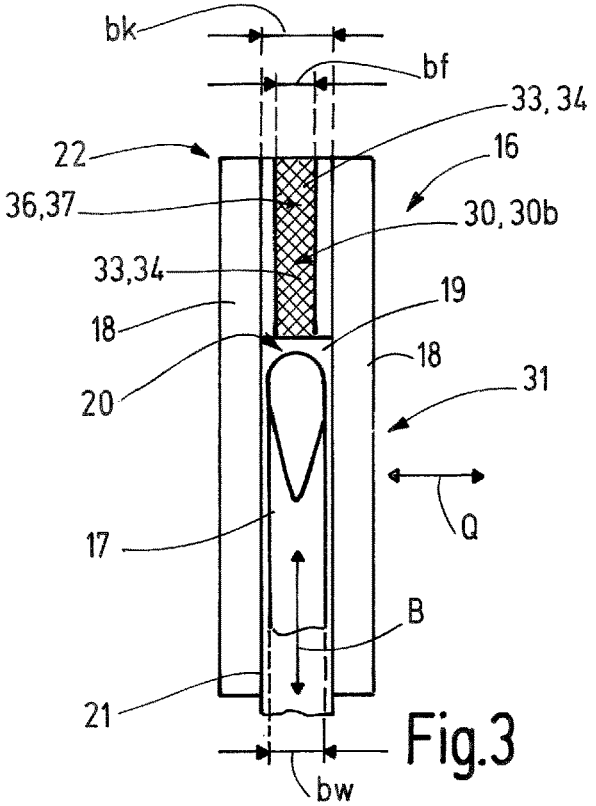
Figure 4:
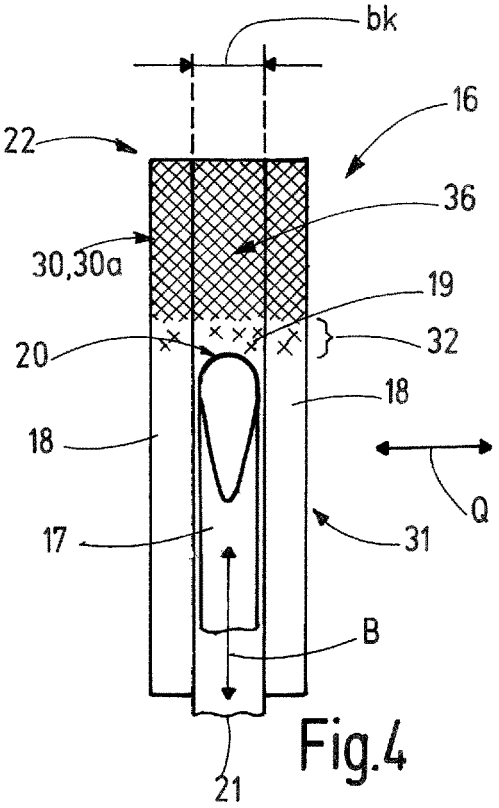
Figure 5:
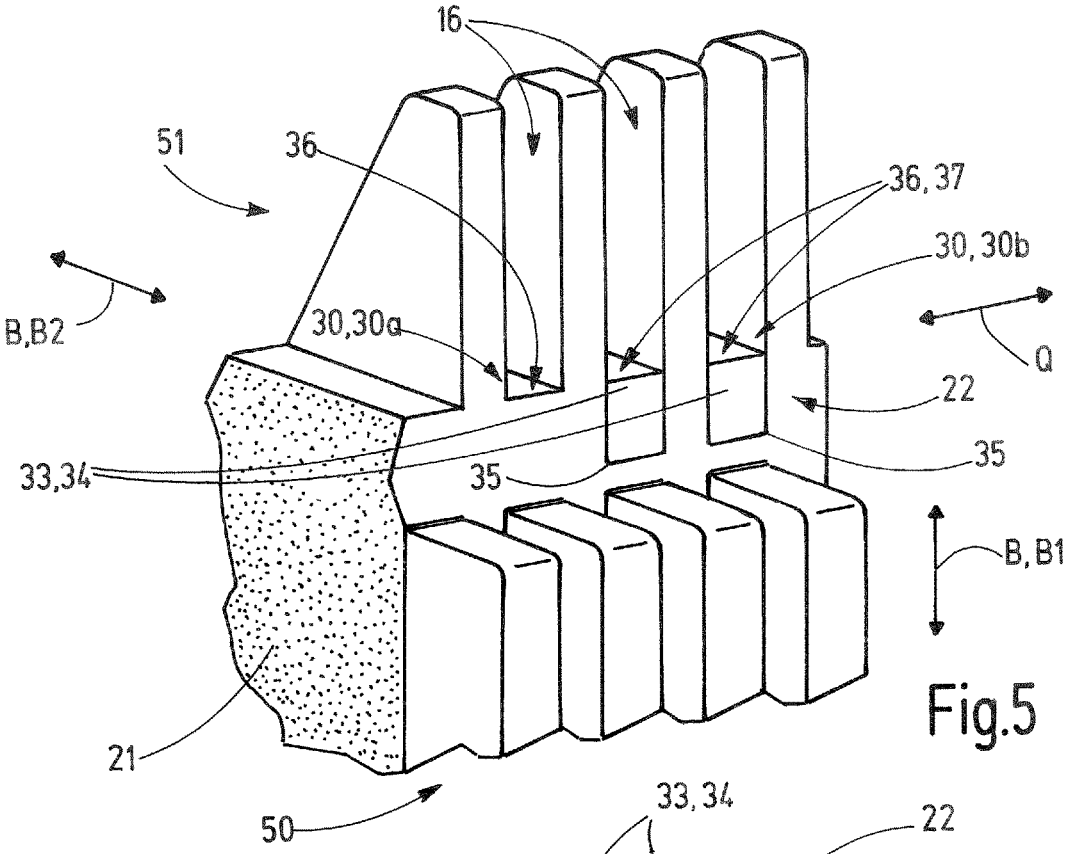
Figure 10:
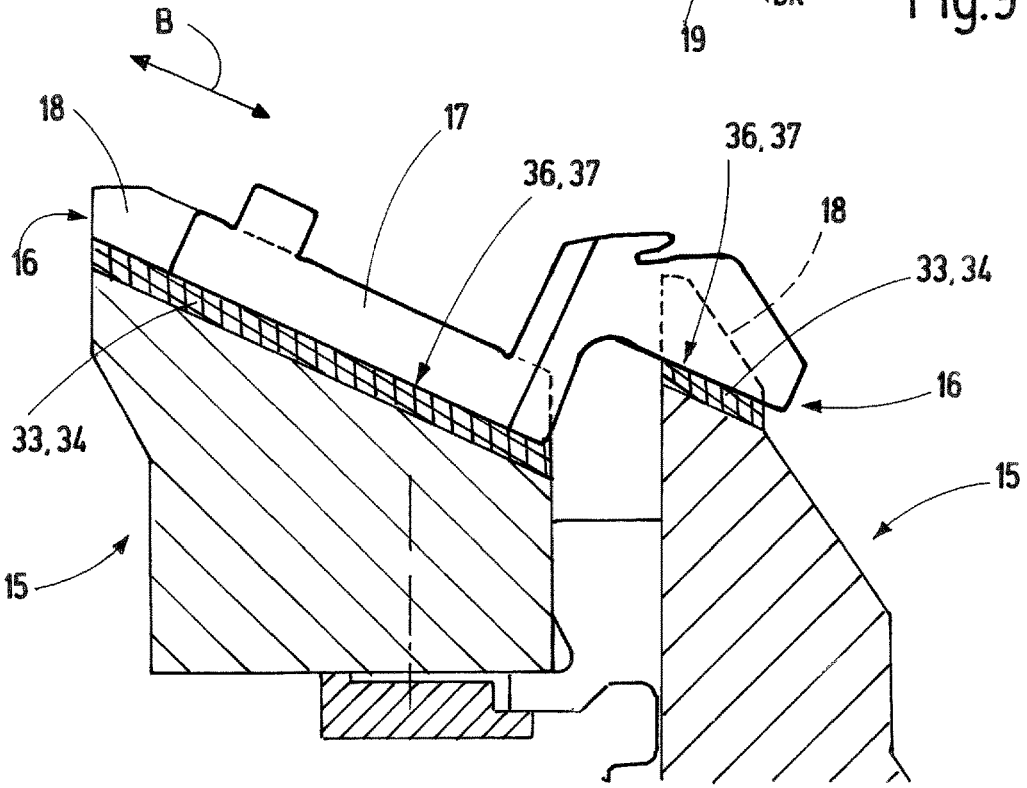

In FIGS. 1 and 2 two exemplary embodiments of knitting machine parts 15 are perspectively illustrated. The knitting machine part 15 of FIG. 1 is a knitting machine part 15 that is continuously ring-shaped in a circumferential direction U, e.g. a circular knitting cylinder. The embodiment of the knitting machine part 15 shown in FIG. 5 is a needle bed of a flat bed knitting machine. The knitting machine part 15 in terms of the present invention can also be rib discs, sinker rings or other knitting machine parts 15 that have multiple tool guides 16 for guiding one knitting tool 17 in each case that is movable in a movement direction B. In FIGS. 3 and 4 tool guides 16 for a knitting tool 17 are schematically illustrated, wherein the knitting tool 17 is exemplarily formed by a knitting machine needle. The knitting tool 17 can also be a sinker, as exemplarily shown in FIG. 10.

For guiding the respective knitting tool 17 the tool guide 16 comprises two side webs 18 that are arranged with distance in a transverse direction Q orthogonal to the movement direction B in the described embodiments. The two side webs 18 limit a guide channel 19 arranged between the side webs 18. According to the example, the guide channel 19 is limited on one side orthogonal to the movement direction B of the knitting tool 17 and orthogonal to the transverse direction Q by a support surface 20 that is arranged at a base body 21 of the knitting machine part 15. The support surface 20 can also extend partly outside the guide channel 19. The side webs 18 extend away from the base body 21. On the side opposite the support surface 20 the guide channel 19 is open according to the example. In modified embodiments the guide channel 19 can also be at least partly closed opposite the support surface 20.

With view in movement direction B of the respective knitting tool 17 each guide channel 19 or each tool guide 16 has an end 22 that is assigned to a location or an area of the knitting machine part 15 in which the loop formation occurs. During loop formation the knitting tool 17 is moved in movement direction B along the tool guide 16 and is particularly moved or slided out of the respective tool guide 16 beyond the end 22 in order to catch a thread section or to form a loop in cooperation with other knitting tools outside the tool guide 16 or outside the guide channel 19.

In the area of this end 22 a knitting machine part 15 or the respective tool guide 16 is subject to particular high stress that can cause respective high wear. Thus, each tool guide 16 of the knitting machine part 15 comprises a hardened section 30 beginning at the end 22. In the hardened section 30 the material of the respective tool guide 16 has a greater hardness than in a non-hardened section 31 adjoining the hardened section 30. The material of the knitting machine part 15 or the tool guide 16 can be the same in the hardened section 30 and in the non-hardened section 31, however, comprise different micro-structures such that different hardnesses are obtained.

The hardened section 30 is configured as integral section 30*a* in the majority of the tool guides 16 of the knitting machine part 15. This means that the integral section 30*a* transitions without seam or connection location in the non-hardened section 31. In doing so, a transition zone 32 can be present between the hardened integral section 30*a* and the non-hardened section 31 in which the hardness starting from the non-hardened section 31 increases up to the hardened section 30. In FIG. 4 the hardened integral section 30*a* is illustrated by crosshatch. In the schematically illustrated transition zone 32 the crosshatch is illustrated with less density in order to schematically illustrate the hardness that reduces toward the non-hardened section 31.

The hardened sections 30 that are configured as integral sections 30*a* are present in most of the tool guides 16, preferably in at least 90% or at least 95% or at least 98% of the tool guides 16 of the knitting machine part 15. According to the example, for this the knitting machine part 15 is first manufactured from a non-hardened material and subsequently hardened in the section adjoining the ends 22 of the tool guides 16 in order to form the multiple hardened integral sections 30*a* in a hardening process. For example, this hardening can be carried out by induction hardening using an inductor for heating and a cooling device for quick cooling. In doing so, a micro-structural transformation of the material and thus an increased hardness can be achieved in the hardened integral section 30*a*.

In such a hardening process, depending on the kind of used method and/or the used device, it can occur that at one or more but a few tool guides 16 no sufficient hardness can be achieved in the section adjoining the end 22. For example, this can be caused in that the hardening of one or more adjacent tool guides 16 results in tempering of an already hardened section, the hardness of which thereby decreases again. This is particularly the case, if the knitting machine part 15 is a ring-shaped continuous component, whereby the inductor is moved in circumferential direction U along the section of the tool guides 16 to be hardened.

Figure 6:
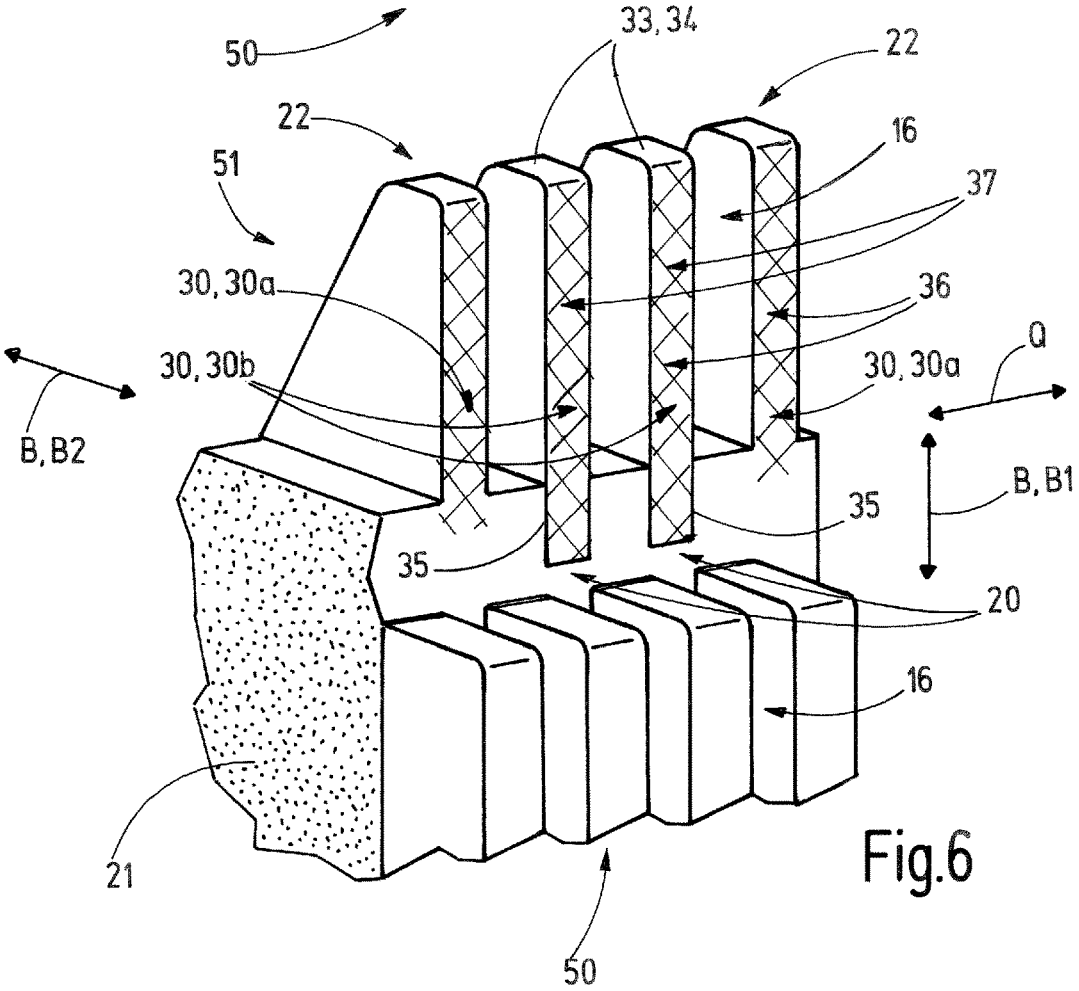

In such a case individual hardened sections 30 can be formed by hardened non-integral sections 30*b*, as schematically illustrated in FIGS. 3, 5, 6 and 8-10 for example. For forming such hardened non-integral sections 30*b* a hardened separate component 33 is arranged at the location of the tool guide 16 at which a higher hardness is desired. Preferably the hardened component 33 is configured as insert part 34 and is inserted into a reception recess 35 at the tool guide 16. Thereby the separate hardened component 33 can be completely arranged inside the reception recess 35 (FIGS. 3, 5 and 8-10) or can be arranged only partly inside the reception recess 35 and can project out of the reception recess 35 (FIG. 6).

In the embodiment a reception recess 35 is created originating from the end 22 of a tool guide 16 that does not have a sufficient hardness adjacent to the respective end 22 and subsequently the already hardened separate component 33 is inserted into the reception recess 35 as insert part 34. In doing so, a non-integral hardened section 30*b* is obtained that is formed by the separate component 33. Thus, the hardness changes in a step-like manner between the component 33 or the insert part 34 and the non-hardened section 31 or the at least non-sufficiently hardened section of the tool guide 16 adjoining thereto (FIG. 3). The hardened non-integral section 30*b* is thus defined by the form of the component 33 and definitely limited without transition zone.

As it is exemplarily illustrated in FIGS. 3 and 4, the support surface 20 extends into the respective hardened section 30 up to the end 22 of the tool guide 16 such that the support surface 20 forms a hardened surface section 36 in the hardened section 30 respectively. In the hardened non-integral section 30*b* the hardened surface section 36 is formed by the component surface 37 of the arranged component 33 or the insert part 34 inserted into the reception recess 35.

The hardened surface section 36 of the support surface 20 can extend at least partly or completely in the guide channel 19 between the side webs 18 and/or can be arranged partly or completely outside of the guide channel 19 (FIG. 6).

The component 33 or the insert part 34 is connected to the base body 21 of the knitting machine part 15, preferably by adhesive bond or of another suitable manner, particularly by substance bond.

Figure 9:
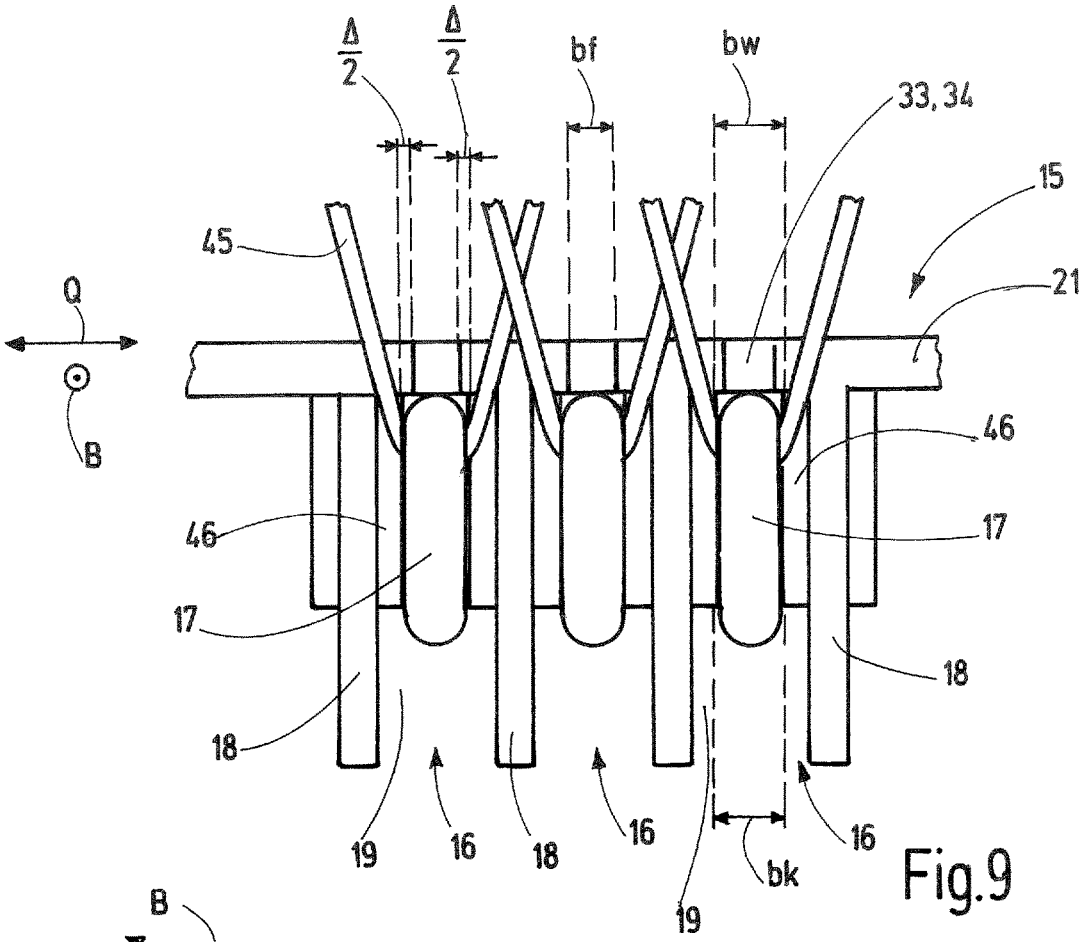

As is illustrated in FIGS. 3 and 9, the component surface 37 that forms the hardened surface section 36 in a non-integral section 30*b* comprises a surface with bf that is smaller than the tool width bw of the knitting tool 17. The tool width bw of the knitting tool 17 is in turn smaller than the channel width bk of the guide channel 19.

The difference between the channel width bk and the tool width bw forms a guide play between the knitting tool 17 and the tool guide 16. According to the example, the sum of the surface width bf and the guide play is smaller than the tool width bw. In FIG. 9 also the difference Δ between the surface width bf and the tool width bw is illustrated.

In a preferred embodiment the guide play between the knitting tool 17 and the tool guide 16 or the guide channel 19 can be about up to 0.07 mm. Preferably, the surface width bf can have an amount of at least 80% of the tool width bw.

As can be schematically seen also in FIG. 9, the knitting tool 17, particularly the knitting machine needle, can be configured to guide a thread section 45 and to at least partly pull the thread section 45 in the guide channel 19. For this the guide channel 19 can comprise a respective enlarged section adjoining to the end 22 in which thread cavities 46 are provided in the side webs 18 (compare particularly FIGS. 7 and 8). This enlarged section does not serve to guide the knitting tool 17 and thus does not define the effective channel width bk for guiding the knitting tool 17.

Figure 7:
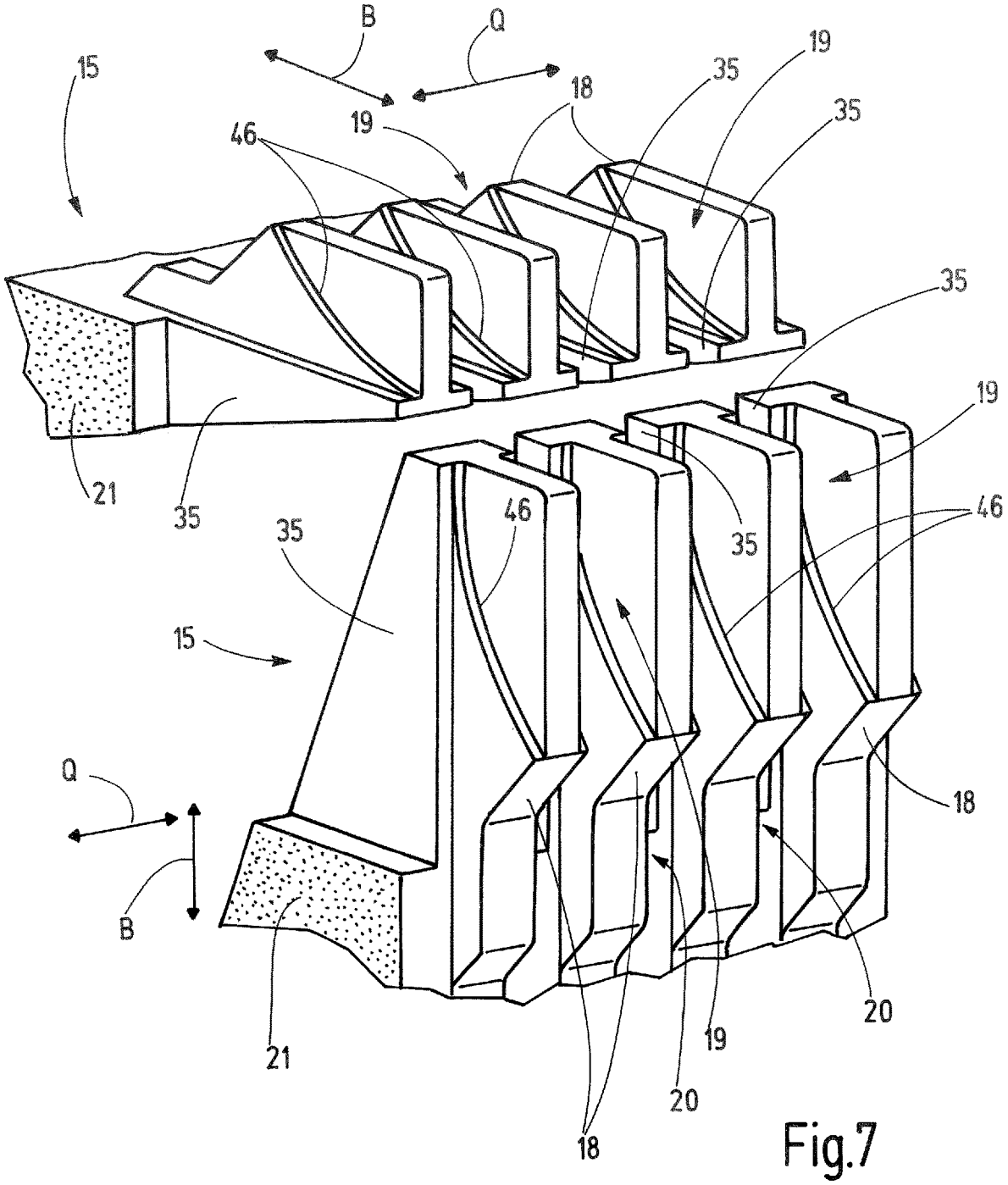
Figure 8:
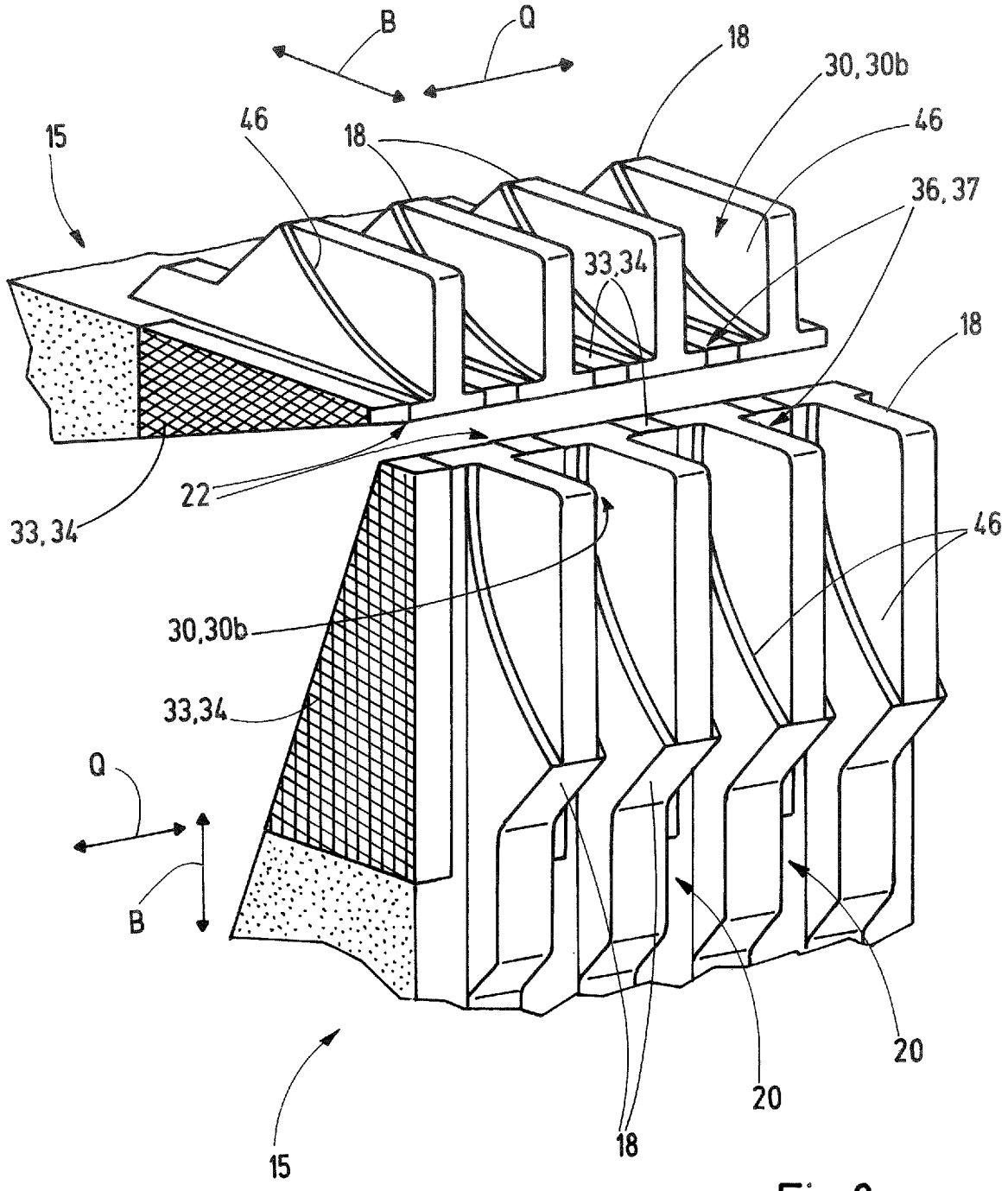

In the embodiments of the knitting machine part, according to FIGS. 1, 7 and 8, only one single group of tool guides 16 is provided for the knitting tools respectively. In modification thereto a knitting machine part 15 can also comprise a first group 50 and a second group 51 of tool guides 16. The tool guides of the first group 50 guide the assigned knitting tools 17 in a first movement direction B1 and the tool guides 16 of the second group 51 guide the assigned knitting tools 17 in a second movement direction B2. The first movement direction B1 and the second movement direction B2 can be orientated orthogonal to each other, for example, and have preferably a common transverse direction Q. For example, the first movement direction B1 can be orientated axially and the second movement direction B2 can be orientated radially, if the knitting machine part 15 or knitting machine parts 15 is/are configured in a ring-shaped manner in circumferential direction U about an axis.

The two groups 50, 51 of the tool guides 16 can also be provided for different kinds of knitting tools, for example, wherein e.g. the first group 50 can be configured to guide knitting needles and the second group 51 can be configured to guide sinkers.

Figure 11:
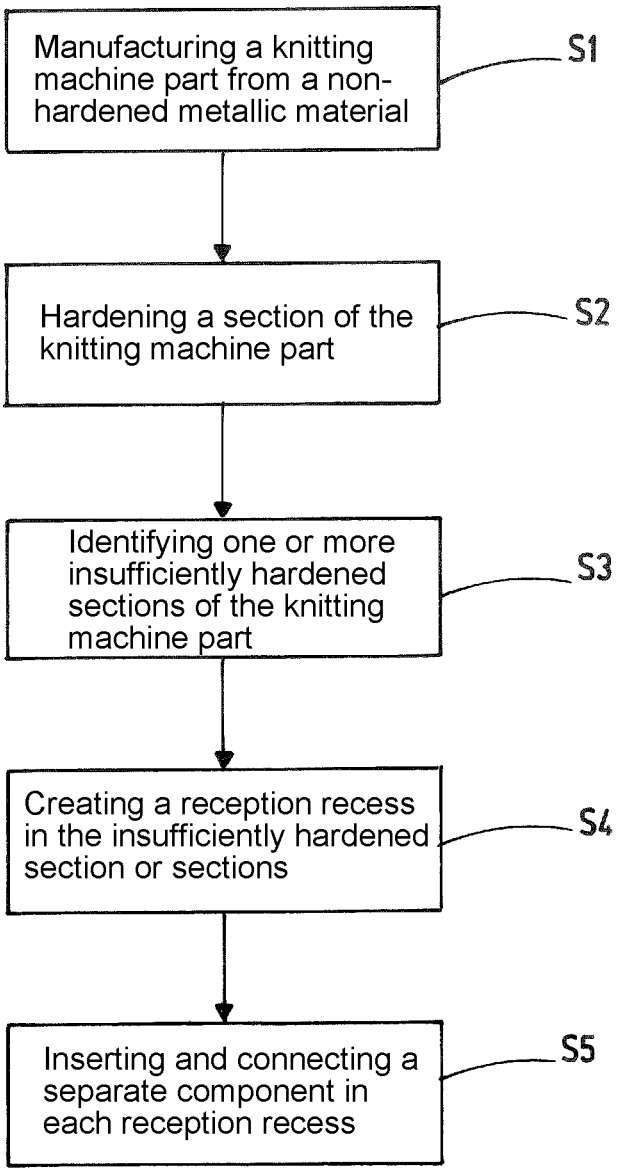

In FIG. 11 an embodiment of a method for manufacturing a knitting machine part 15 is illustrated.

In a first step S1 the knitting machine part 15 is manufactured from a non-hardened metallic material, such that a machining by cutting is possible. Preferably, the initially non-hardened knitting machine part consists of one single body.

After manufacturing of the non-hardened knitting machine part in the first step S1 a section of the non-hardened knitting machine part in the area of the ends 22 of the tool guides 16 is hardened (second step S2), such that at least at most of the tool guides 16 a hardened section 30 is formed as integral section 30*a* that transitions without seam or connection location in the adjoining non-hardened sections 31. The hardening of the knitting machine part 15 can be carried out as induction hardening for example.

Depending on the used method and the used device for hardening in the second step S2, it can occur that hardened section 30 having a sufficient hardness is not formed at each tool guide 16. In a third step S3 those tool guides 16 are identified that comprise an insufficiently hardened section. Usually these are few individual tool guides 16, e.g. one to five tool guides 16 of each group 50, 51 of tool guides 16.

In these insufficiently hardened sections identified in the third step S3 a reception recess 35 is created in each case in a fourth step S4, e.g. by milling. An already hardened separate component 33, that can also be referenced as insert part 34, is inserted in each reception recess 35 such that it is completely or partly arranged in the reception recess 35 (fifth step S5). This hardened component forms a hardened non-integral section 30*b*. A component surface 37 of the component 33 provides a hardened surface section 36 on which the assigned knitting tool 17 is placed in the tool guide 16. The component 33 or the insert part 34 is fixed in the reception recess 35 by use of an adhesive.

The invention refers to a knitting machine part 15 for assembly in a knitting machine, as well as a method for manufacturing thereof. The knitting machine part 15 comprises a plurality of tool guides 16 for one knitting tool 17 respectively. Each tool guide has a hardened section 30. The majority of the hardened sections 30 are integrally configured without seam and connection location, such that they can be referenced as integral sections 30*a* that transition integrally in adjoining non-hardened sections 31. At least one hardened section 30 of the knitting machine part 15 is formed by a non-integral section 30*b* in that a hardened separate component 33 is arranged there that forms the non-integral section 30*b*. The component 33 can be configured as insert part 34 and can be inserted in a reception recess 35. The integral sections 38 are preferably formed by induction hardening of a knitting machine part 15 that is not yet hardened wherein in each insufficiently hardened section a separate hardened component 33 can be arranged in order to provide a hardened non-integral section 30*b*.

LIST OF REFERENCE SIGNS

15 knitting machine part
16 tool guide
17 knitting tool
18 side web
19 guide channel
20 support surface
21 base body
22 end of tool guide
30 hardened section
30*a* integral section
30*b* non-integral section
31 non-hardened section
32 transition zone
33 component
34 insert part
35 reception recess
36 hardened surface section
37 component surface
45 thread section
46 thread cavity
50 first group of tool guides
51 second group of tool guides
B movement direction
B1 first movement direction
B2 second movement direction
Q transverse direction
S1 first step
S2 second step
S3 third step
S4 fourth step
S5 fifth step
U circumferential direction

The invention claimed is:

1. A knitting machine part (15), comprising:

multiple tool guides (16) that are individually configured to guide a knitting tool (17) that is movable in a movement direction (B), wherein individual ones of the multiple tool guides (16) each comprise a knitting tool support surface (20) for supporting the knitting tool (17), the knitting tool support surface (20) formed by a hardened section (30)

and a non-hardened section (31), wherein the hardened section (30) has a hardness that is greater than a hardness of the non-hardened section (31), wherein a majority of the hardened sections (30) are configured as integral section (30*a*) that are each monolithically configured with the non-hardened section (31) of a corresponding tool guide (16) of the multiple tool guides (16) such that the knitting tool support surface (20) formed by the monolithically configured hardened and non-hardened sections (30*a*, 31) is seamless, and wherein at least one of the hardened sections (30) is configured as a non-integral section (30*b*) that comprises at least one separate component (33) that is fixedly connected with the non-hardened section (31) of a corresponding tool guide (16) of the multiple tool guides (16).

2. The knitting machine part according to claim 1, wherein at most 10% of the hardened sections (30) are configured as non-integral sections (30*b*).

3. The knitting machine part according to claim 1, wherein the non-integral section (30*b*) consists of exactly one separate component (33).

4. The knitting machine part according to claim 1, wherein at least one section of the knitting tool support surface (20) is arranged in the respective hardened section (30) and forms a hardened surface section (36).

5. The knitting machine part according to claim 4, wherein the hardened surface section (36) is formed by a component surface (37) of the at least one separate component (33) in the non-integral sections (30*b*).

6. The knitting machine part according to claim 5, wherein the component surface (37) comprises a surface width (bf) in a transverse direction (Q) orthogonal to the movement direction (B) of the knitting tool (17) that is smaller than a tool width (bw) of the knitting tool (17).

7. The knitting machine part according to claim 6, wherein individual ones of the multiple tool guides (16) each comprise two side webs (18) that delimit a guide channel (19) with a channel width (bk) in a transverse direction (Q) orthogonal to the movement direction (B) of the knitting tool (17).

8. The knitting machine part according to claim 7, wherein a difference between the channel width (bk) and the tool width (bw) of the knitting tool (17) results in a guide play and a sum of the surface width (bf) and the guide play is smaller than the tool width (bw).

9. The knitting machine part according to claim 8, wherein the surface width (bf) is smaller than the channel width (bk).

10. The knitting machine part according to claim 1, wherein the at least one separate component (33) of the non-integral section (30*b*) is configured as an insert part (34) that is inserted in a reception recess (35) of the knitting machine part (15).

11. The knitting machine part according to claim 1, further comprising a body having a continuously ring-shaped configuration in a circumferential direction (U).

12. The knitting machine part according to claim 1, wherein at least one group (50, 51) of the tool guides (16) is configured to guide knitting needles.

13. The knitting machine part according to claim 1, wherein at least one group (50, 51) of the tool guides (16) is configured to guide sinkers.

14. A method for manufacturing a knitting machine part (15) with multiple tool guides (16) that are configured to guide a knitting tool (17) that is movable in a movement direction (B) along the tool guide (16) respectively, comprising the following steps:

manufacturing a knitting machine part (15) of a non-hardened material, hardening a section of the knitting machine part (15) to create a hardened integral section (30*a*) at a majority of the tool guides (16) respectively, identifying one or more insufficiently hardened sections of one or more tool guides (16) in which only an insufficient material hardness was created by the hardening of the section the knitting machine part (15), creating a reception recess (35) in each of the one or more insufficiently hardened sections respectively, inserting a separate component (33) in each of the one or more reception recesses (35) respectively and connecting each of the one or more separate components (33) with the knitting machine part (15) for forming at least one hardened non-integral section (30*b*).

15. The method according to claim 14, wherein the hardening of the section of the knitting machine part (15) is carried out by induction hardening.

* * * * *